United States Patent [19]

Fredriksson

[11] Patent Number: 4,642,887

[45] Date of Patent: Feb. 17, 1987

[54] METHOD OF MANUFACTURING LOOP-FORMED METAL FOIL ELEMENTS

[75] Inventor: Tommy Fredriksson, Hallstahammar, Sweden

[73] Assignee: Kanthal AB, Hallstahammar, Sweden

[21] Appl. No.: 768,592

[22] Filed: Aug. 23, 1985

[30] Foreign Application Priority Data

Aug. 24, 1984 [SE] Sweden ..... 8404231

[51] Int. Cl.[4] ..... H05B 3/00

[52] U.S. Cl. ..... 29/611; 29/613; 29/415

[58] Field of Search ..... 29/611, 613, 412, 415, 29/846–848; 156/250, 213; 338/293; 219/528

[56] References Cited

U.S. PATENT DOCUMENTS

| | | | |
|---|---|---|---|
| 1,498,969 | 6/1924 | Homan | 338/293 |
| 1,606,282 | 11/1926 | Witter | 29/412 |
| 3,495,328 | 2/1970 | Ziver | 29/611 |
| 3,878,018 | 4/1975 | Cospen et al. | 156/290 |

FOREIGN PATENT DOCUMENTS

| | | | |
|---|---|---|---|
| 3334744 | 4/1984 | Fed. Rep. of Germany | 219/528 |

*Primary Examiner*—Howard N. Goldberg
*Assistant Examiner*—P. W. Echols
*Attorney, Agent, or Firm*—Pollock, Vande Sande & Priddy

[57] ABSTRACT

Method of manufacturing two loop-formed metal foil elements (1,2) intended to serve as electrical resistance heating elements. Starting from a unitary metal foil, possibly enclosed by plastic foils, at least two complementarily extending loop elements, one inside the other.

4 Claims, 3 Drawing Figures

METHOD OF MANUFACTURING LOOP-FORMED METAL FOIL ELEMENTS

FIELD OF THE INVENTION

The present invention relates to a method of manufacturing loop-formed metal foil elements intended to serve as electrical resistance heating elements.

BACKGROUND OF THE INVENTION

Such metal foil elements are known, e.g., from No. SE-A-7713250-4, and are being used more and more for various heating purposes, e.g., for heating car seats or other flexible surface elements, or for heating rigid surfaces, possibly having a complicated geometrical, in particular curved shape. For such purposes, it is usually essential that the loop-formed metal foil element cover a relatively large surface area, although the mutually adjacent parts of the loop element should preferably be well separated from each other, e.g., to enable stretching during assembly or use of the element.

The manufacture of such loop elements with relatively sparsely distributed loop portions has hitherto involved a great waste of material, since the material between the loop portions was discarded. Moreover, conventional methods of printing and etching of loop patterns are extremely complicated and cumbersome.

The object of the invention is to achieve a manufacturing method in which the waste of material is considerably reduced and which, moreover, permits an especially simple method of manufacture, namely, punching.

SUMMARY OF THE INVENTION

Starting from a unitary metal foil, this object is achieved by simultaneously forming, particularly by punching, at least two complementarily extending loop elements, one inside the other. In this connection, it has rather surprisingly turned out that the difference in length, and thus in resistance, of two adjacent meander-shaped loop elements of the same width only amounts to a few percent, and such loop elements can therefore be used for the same purpose, e.g., in car seats.

In practice, two or three loop elements, located one inside the other, can be formed at the same time, but in principle, even four or more loop elements may be produced. Already in case of two complementary elements, up to about 70–80% of the material can be used, which means a considerable economic saving compared to conventional manufacturing methods. Moreover, the waste obtained when forming by punching is better suited for re-use than that obtained by etching.

Thus, the loop elements located inside each other will be approximately equal in length. If desired, the actual differences in length, which are small, may be compensated by making the shorter loop elements somewhat narrower so that the resistance becomes equal.

From the point of view of productivity, it is advantageous to punch a laminate consisting of the metal foil itself and two cover foils of thermoplastic material, e.g., polyester, on each side thereof, the two cover foils being stretched over the edges of the metal foil loop elements and being joined along these edges under the influence of heat, so that the metal foil loop elements are entirely closed by the cover foils. The joining can possibly be effected during the punching operation by an adjusted design and heating of the punching tools.

Suitably, the punching is performed by means of stamp and die, but principally, even a cutting punch can be used. A possible alternative to the punching operation is conventional production by etching the loop elements located inside each other. In such a case, a metal foil is applied to a supporting layer, preferably of thermosplastic material, such as polyester, and after etching the complementry loop elements a cover layer may be applied. Thereafter, the loop elements are punched out together with the metal foil loops enclosed between the enclosing layers.

BRIEF DESCRIPTION OF THE DRAWINGS

The invention will now be described with reference to the appended drawings, in which an embodiment of the invention is shown for purposes of illustration, and in which.

DETAILED DESCRIPTION

Figure 1:
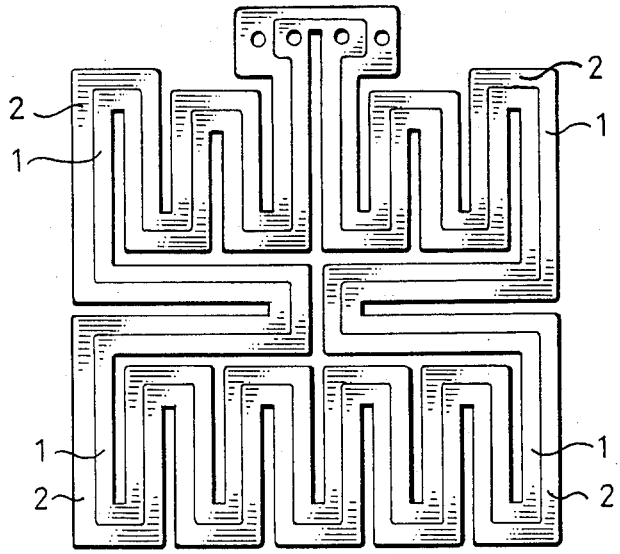
FIG. 1 shows in plan view two foil loops, one inside the other, which have been punched out from a unitary foil laminate.
Figure 3:
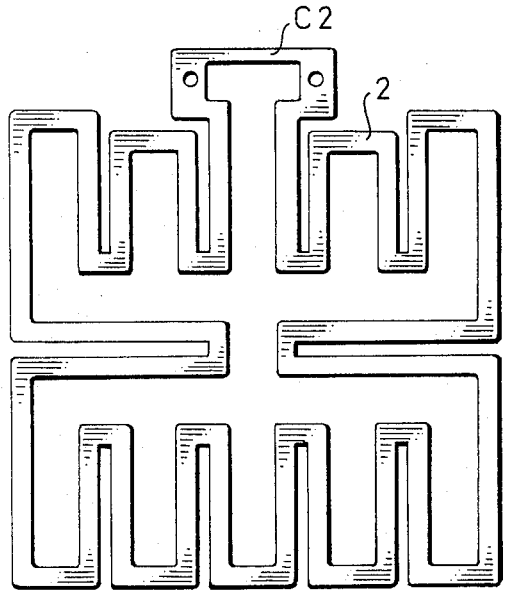
FIGS. 2 and 3 show each of the two loop elements separately.
Figure 2:
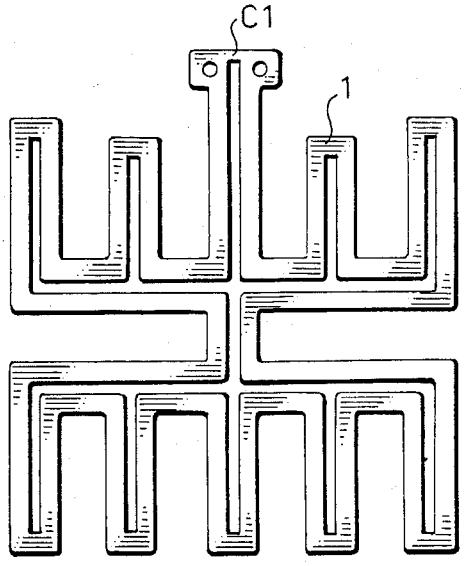

The embodiment illustrated in FIG. 1 consists of two foil loop elements 1,2 located one closely inside the other and having complementary meander loop portions, also shown in FIGS. 2 and 3, illustrating the configuration of each loop element 1,2. As is known from Nos. SE-A-7713250-4 and SE-A-8205712-6 the different loop portions extend in different main directions, i.e., substantially perpendicular to each other.

With such an arrangement, it has turned out that the difference in resistance between the elements 1,2 in FIGS. 2 and 3 is only about 2%.

In the illustrated example the metal foil is made of a rust-proof plate material having a thickness of about 35 μm. The metal foil is enclosed at both sides by polyester plastic which is punched simultaneously in one operation by means of a punch tool formed in correspondence to the configuration shown in FIG. 1.

In general, the metal foil may have a thickness of 20–100 μm. If three loop elements are punched out at the same time, the thickness should be larger than the thickness of only two coil members, e.g., about 50 μm.

In the embodiment the punched out loop elements are shortcircuited by a metal connection C1 (FIG. 2) and C2 (FIG. 3), respectively. The purpose of this connection is to make the element stable enough during the assembly of the connection cables and an outer casing, e.g., in the form of a plastic net. Thereafter, the connection is cut away. As an alternative to such metal connections, one of the plastic foils, e.g., the lower one, may have larger dimensions than the metal foil and the other plastic foil, so that a protruding plastic foil portion (not to be punched) constitutes the desired connection, which provides the member with the necessary stability during assembly.

Of course, the form of the loop may vary to adapt it for the intended use. Thus, the meander loops may extend in mutually oblique main directions or in only one main direction. The loop elements need not be meander-shaped, but may have any, preferably closed, configuration. The essential feature is that the loop elements are situated complementarily one inside the other and together cover the major part of the surface area in question so as to reduce the waste of material.

I claim:

1. A method of manufacturing loop-formed metal foil elements intended to serve as electrical resistance heating elements and having substantially the same electrical resistance, comprising simultaneously forming at least two loop elements (1, 2) from a unitary metal foil, said loop elements extending complementarily inside one another and jointly covering at least 70% of the surface area confined within the outer contour of the outer of the at least two elements.

2. A method according to claim 1, wherein said loop elements are formed by punching from a laminate consisting of said metal foil and two cover foils of thermoplastic material arranged on both sides thereof, stretched over edges of said metal foil loop elements and joined along said edges under the influence of heat, so that said metal foil loop elements are entirely enclosed all around by said cover foils.

3. A method according to claim 2, wherein said joining under the influence of heat is effected during the punching operation.

4. A method according to claim 1, wherein said loop elements (1, 2) have a substantially closed configuration.

* * * * *